US007157863B2

(12) United States Patent
Eckert

(10) Patent No.: US 7,157,863 B2
(45) Date of Patent: Jan. 2, 2007

(54) DEVICE AND METHOD FOR THE MULTI-PHASE OPERATION OF A GAS DISCHARGE OR METAL VAPOR LAMP

(75) Inventor: Dietrich Eckert, Durchhausen (DE)

(73) Assignee: Eckert Electronik GmbH, Durchhausen (DE)

( * ) Notice: Subject to any disclaimer, the term of this patent is extended or adjusted under 35 U.S.C. 154(b) by 0 days.

(21) Appl. No.: 10/466,350

(22) PCT Filed: Nov. 8, 2001

(86) PCT No.: PCT/EP01/12950

§ 371 (c)(1),
(2), (4) Date: Dec. 3, 2003

(87) PCT Pub. No.: WO02/056644

PCT Pub. Date: Jul. 18, 2002

(65) Prior Publication Data

US 2004/0085032 A1 May 6, 2004

(30) Foreign Application Priority Data

Jan. 15, 2001 (DE) ..... 101 02 408

(51) Int. Cl.
*H05B 37/02* (2006.01)

(52) U.S. Cl. ..... 315/224; 315/307; 315/DIG. 5; 315/DIG. 7

(58) Field of Classification Search ..... 315/224, 315/307, DIG. 5, DIG. 7
See application file for complete search history.

(56) References Cited

U.S. PATENT DOCUMENTS

| | | | | |
|---|---|---|---|---|
| RE33,057 | E * | 9/1989 | Clegg et al. | 315/224 |
| 6,034,489 | A * | 3/2000 | Weng | 315/307 |
| 6,037,722 | A * | 3/2000 | Moisin | 315/307 |
| 2005/0035729 | A1 * | 2/2005 | Lev et al. | 315/291 |

FOREIGN PATENT DOCUMENTS

EP 0489477 A1 * 6/1992

* cited by examiner

*Primary Examiner*—David Vu
(74) *Attorney, Agent, or Firm*—Fattibene & Fattibene; Paul A. Fattibene; Arthur T. Fattibene

(57) ABSTRACT

The present invention describes an apparatus and methods for operating one or more gas arc lamps or metal vapor, wherein a rectified multiphase voltage is directly used by an electronic ballast device without intermittently connecting any active component, so as to achieve an efficient control of a gas arc lamp with a reduced interference radiation, wherein the power factor is inherently higher than 0.95.

17 Claims, 2 Drawing Sheets

DEVICE AND METHOD FOR THE MULTI-PHASE OPERATION OF A GAS DISCHARGE OR METAL VAPOR LAMP

FIELD OF THE INVENTION

The present invention relates to apparatus and methods for operating a gas arc lamp and, in particular, relates to light equipment in which gas arc lamps are operated by means of an electronic ballast device.

BACKGROUND OF THE INVENTION

The employment of gas arc lamps and especially of fluorescent lamps is common practice in many industrially and economically oriented fields due to their higher efficiency when compared to filament lamps and due to illumination characteristics that are widely variable by selecting the fluorescent coating. In particular, for applications in which not only high efficiency but also a stable, i.e. flicker-free, illumination or a continual adjustment of the luminescence of a gas arc lamp is required, electronic ballast devices are often used that enable an operation of the gas arc lamp at high frequencies in the range of approximately 20 kHz to 50 kHz. Consequently, the flicker may be avoided or is no longer perceivable contrary to gas arc lamps that are merely operated at the grid frequency by means of a choke, wherein an appropriate control of the electronic ballast device enables the variation of the illumination intensity within a wide range.

The increasing employment of electronic ballast devices, however, entails an increased transmission of interfering signals that are generated by the switched operation of the switching elements—mostly MOSFETs- or bipolar transistors—used in the electronic ballast device. Moreover, the application of electronic ballast devices causes a significant non-sinusoidal current extraction from the grid, which leads to a remarkable supply of upper harmonic waves into the grid, thereby resulting in an undue loading of the grid. Consequently, legislators have issued corresponding guidelines with respect to the creation of upper harmonic waves of electronic ballast devices, especially in the power range up to 1000 W, which may not be exceeded. For this reason, a multiplying boost converter precedes the electronic ballast device, which is also referred to as a "power factor regulator," so as to maintain the power factor at approximately 1, i.e., to extract the current from the grid in a substantially sinusoidal form and in phase with the grid voltage.

The power factor regulator generally requires a further switching element and an inductor, thereby causing a significant increase in the number of circuit elements. Furthermore, with reasonable effort typically an efficiency of the power factor regulator of 95% at most is achievable, so the total efficiency of the system comprised of the power factor regulator, the electronic ballast device and the gas arc is reduced. The boost converter used in the power factor regulator operates in a switched mode and contributes to a further increase of the interference radiation, thereby requiring great effort to filter the interference radiation and necessitating expensive metal housings.

SUMMARY OF THE INVENTION

In view of the problems identified above, it is an object of the present invention to provide a technique for reducing the expense in terms of circuit elements, thereby at the same time assuring the required degree of electromagnetic compatibility (EMC) and reduced amount of harmonic waves.

According to one aspect of the present invention, this object is solved in that an apparatus is provided for controlling the illumination of a gas arc lamp and/or a metal vapor lamp, the apparatus comprising: a multiphase full-wave rectifier that is at the input side connected to a multiphase voltage source, and a controlled switch device that is connected with its input side to the output of the multiphase full-wave rectifier and that is connected with its output side to a resonant circuit to which the gas arc lamp or the metal vapor lamp may be connected. Moreover, the apparatus comprises a control circuit for driving the switch device in accordance with an externally supplied control signal so as to control the energy coupled into the gas arc lamp or the metal vapor lamp, wherein the power factor of the apparatus is greater than 0.95 due to the rectified multiphase voltage.

By rectifying the multiphase AC voltage by means of the full-wave rectifier, a DC voltage that exhibits a reduced waviness is obtained at the output of the rectifier. For example, in the European three-phase grid, the waviness of a six-phase circuit is only approximately 10% at a frequency corresponding to six times the grid frequency. This rectified voltage may be directly supplied to the electronic ballast device, thereby eliminating the necessity for the complex power factor regulator. Because of the reduced waviness in connection with the higher frequency of the voltage waviness, only slight variations in the illumination of the gas arc lamp or the metal vapor lamp occur. Due to the higher ripple frequency, these variations are imperceivable to the human eye. Excellent illumination characteristics are thereby obtained. Especially in applications requiring a higher power and a control of the average illumination, such as in a solarium and devices for sterilization of rooms and objects in medical fields and the like, the present invention may be most advantageous, since in these applications usually a three-phase terminal is provided anyway and the direct usage of the rectified multiphase voltage without a power factor regulator significantly increases efficiency. Different voltages in different countries (USA and Japan 220V, Europe 380V, outer conductor voltage) may be taken into consideration by a correspondingly adapted resonant circuit, wherein the high rectified voltage of approximately 560V to 600V (Europe) is advantageous for igniting the gas arc lamp.

In a further embodiment, a buffer capacitor is provided at the output side of the multiphase full-wave rectifier. Thus, a short break-down of the voltage caused during the switching of the half-bridge may substantially be avoided. Owing to the direct employment of the rectified multiphase voltage, the capacity of the buffer capacitor may be selected relatively small, since this capacitor does not have to smooth the waviness of the rectified DC voltage; rather the capacitor merely has to buffer the voltage during the switch events occurring at the high operating frequency. Hence, expensive, bulky and unreliable electrolyte capacitors may be omitted.

In a further embodiment, the apparatus further comprises a pre-control that modulates the external control signal inversely with respect to the residual waviness of the rectified multiphase voltage. In this way, even the minor variations of the illumination may be substantially compensated for should these minor variations adversely affect certain applications.

In a further embodiment, a resonant capacitor that is provided in parallel to the gas arc lamp is directly provided at the gas arc lamp.

In this way, the number of leads connecting to the gas arc lamp may be reduced. Especially if a plurality of gas arc lamps are provided, the provision of the respective resonance capacitors directly at the respective gas arc lamp assures that only one lead for each lamp and a common return line is necessary, wherein the required monitoring for the individual gas arc lamps may be performed without additional connections. Preferably, the external resonant capacitor is accommodated within the starter housing.

According to a further aspect of the present invention, a controller is provided for a plurality of gas arc lamps and/or metal vapor lamps. It comprises an electronic wired board, a multiphase full-wave rectifier installed on the electronic board and connectable to a multiphase AC voltage source, and a plurality of electronic ballast devices installed on the electronic board, wherein each of the electronic ballast devices is connected with its input side to the multiphase full-wave rectifier and is connected with its output side to one of the plurality of gas arc lamps and/or metal vapor lamps. As already explained, due to the direct employment of the rectified multiphase AC voltage corresponding power factor regulators and corresponding filter capacitors may be avoided, thereby providing the possibility of supplying a plurality of gas arc lamps and/or metal vapor lamps by a single electronic board in spite of the high power required, since the circuitry may be designed in a compact manner and without additional power factor regulators, which would generate heat that would have to be dissipated. This is especially advantageous in applications in which a plurality of gas arc lamps and/or metal vapor lamps have to be operated within a restricted space.

One or more of the electronic ballast devices may be controllable in such a way that the illumination of the lamps, either individually or in groups or as a whole, is adjustable.

According to a further aspect of the present invention, a controllable illumination apparatus is provided. It comprises a three-phase bridge rectifier; a buffer capacitor having a capacity in the range of approximately 0.1 μF to 1 μF that is arranged at the output side of the three-phase full-wave bridge rectifier; an electronic ballast device having a control input, wherein the electronic ballast device is connected to the buffer capacitor without any intermediate active components; and a gas arc lamp or metal vapor lamp connected to the electronic ballast device.

By means of the direct rectification of the three-phase voltage by using a buffer capacitor having a small capacity, costs with respect to material and fabrication may be reduced, wherein at the same time an excellent EMC and a high power factor are achieved.

According to a further aspect of the present invention, a method for controlling an illumination or lighting equipment is provided, wherein the illumination equipment comprises a multiphase AC voltage source, a multiphase full-wave rectifier, an electronic ballast device and a gas arc lamp or a metal vapor lamp. The method comprises the steps of: rectifying the multphase AC voltage, supplying the rectified voltage to the electric ballast device, generating a control signal that serves the adjustment of the gas arc lamp or metal vapor lamp, and feeding the control signal to the electronic ballast device so as to control the illumination of the gas arc lamp or metal vapor lamp, wherein the power factor is equal to 0.95 or higher.

The operation of the illumination equipment may be carried out in accordance with the present invention so as to significantly reduce the expense at the material side and to provide an increased efficiency compared to the prior art. Hence, for example, a solarium, sterilization equipment and medical devices for treatment in the form of a light therapy and the like may be operated in a significantly increased economical manner, wherein the EMC is within the legal limits at a minimum expense owing to the omission of one or more power factor regulators.

In a further embodiment, the generation of the control signal is based on one or more of the following parameters: a duration of the intended emission of radiation of the gas arc lamp or metal vapor lamp, a current illumination of the gas arc lamp, an illumination integrated over a predefined time interval, an operating age of the gas arc lamp, a physical and/or biological effect on a specified object of the radiation emitted, an operating temperature of the gas arc lamp and an operating temperature of a specified portion of the electronic ballast device.

By means of the parameter-dependent control of the illumination equipment, a controlled adjustment of the illumination within a wide control range is achievable, wherein it is only necessary to adapt the ballast device to the desired power control range due to the missing power factor regulator. Thus effort, in terms of material and costs, is low compared to a conventional apparatus. The generation of the control signal may then occur in an application-specific manner by means of appropriate. parameters. For example, when using the illumination equipment in a solarium, the problem arises that the radiation should be emitted only within a certain frequency range and with a predefined intensity. By providing appropriate sensor elements, the radiation emitted may be monitored and a signal output by the sensors may be used as the parameter for generating the control signal. A corresponding sensor output signal may indicate, for example, that a maximum current radiation intensity and/or a maximum or desired integrated intensity is exceeded.

In one embodiment, the controlling may be performed as a controlled operation by means of a target value and an actual value, so that one or more appropriate parameters may be selected for the specific application, wherein the associated parameter values are read out in a continuous or step-wise manner and used for the generation of the control signal. Hence, for example, the solarium mentioned before may be effectively controlled without any risk with respect to the health of the user, when for instance the current illumination is controlled in accordance with a predefined target value. Especially, in combination with an apparatus as previously discussed, wherein a plurality of gas arc lamps and/or metal vapor lamps are controllable by means of a single electronic board, a compact, energy-efficient and cost-effective possibility for controlling the illumination equipment is achieved on a large scale.

Alternatively or additionally, appropriate parameter values for the control or regulation of the illumination equipment, especially for medical devices for treatment by means of light and radiation, may be obtained from corresponding predefined models of the illumination process or by means of other tools. For instance, by knowing a specific type of skin, a respective mode of operation in the solarium may be determined so as to set corresponding parameters, such as intensity and duration of treatment. The corresponding parameter values may be determined in real time or provided, for instance, in the form of a table.

Similarly, other parameters may be determined, such as the effect of the radiation on certain objects, such as skin areas, micro organisms, specific materials that have to be examined and the like, wherein these parameters may then be used for the control and/or regulation of the irradiation process. Thereby, the effect may be measured and/or determined by models or data. For instance, from previous measurements or calculations, the effects on specific micro organisms with respect to a specified type of radiation may be known so that the illumination may then be appropriately adapted to obtain the desired results, for instance, a specified effect of sterilization. In this respect, it is advantageous that the direct employment of the rectified multiphase grid voltage allows to obtain an efficient and sensitive control for adjustment of the illumination.

Further embodiments are described in the appended claims.

BRIEF DESCRIPTION OF THE DRAWINGS

In the following, a plurality of exemplary embodiments will be described with reference to the accompanying drawings in which.

DETAILED DESCRIPTION OF THE PREFERRED EMBODIMENTS

Figure 1A:
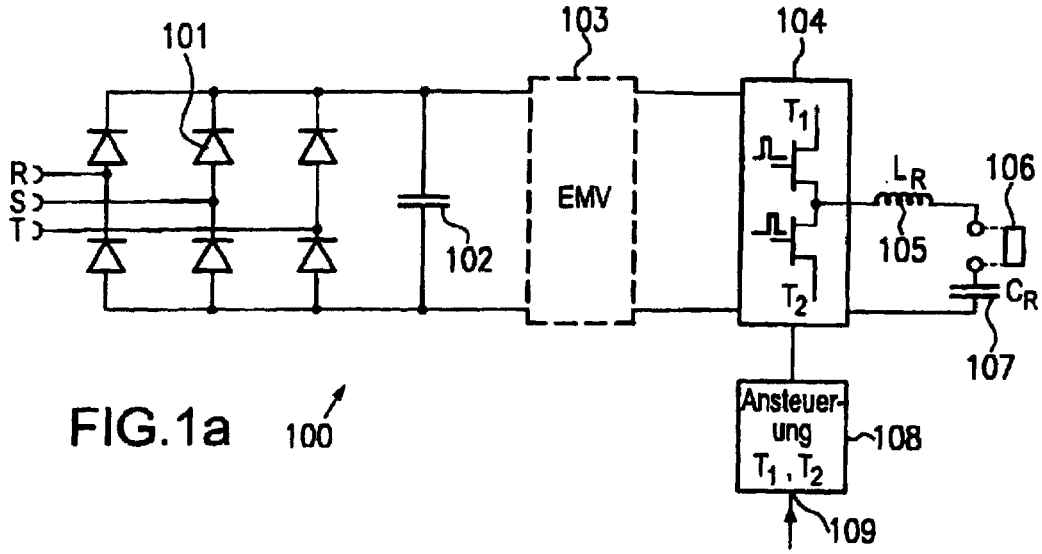
FIG. 1*a* illustrates a circuit diagram of a first exemplary embodiment.

FIG. 1*a* schematically shows an apparatus 100 for controlling a gas arc lamp or a metal vapor lamp 106, which may be provided in the illustrated embodiments in the form of a fluorescent lamp. The apparatus 100 comprises a three phase full-wave rectifier 101 rectifying a three phase AC voltage R, S, T. According to the European standard, the voltage across two phases is approximately 380 volts so that the voltage at the output side of the rectifier 101 is approximately 560 volts, wherein the residual ripple or waviness of the rectified voltage is approximately 10%. Due to the sixth-pulse circuit arrangement of the rectifier 101 the waviness exhibits a frequency that is six times the frequency of the input AC voltage.

At the output side of the rectifier 101 a buffer capacitor 102 may be provided, the capacity of which may be, however, relatively low, for instance 0.1 μF to 1 μF, since the capacitor 102 does not need to smooth the residual waviness of the rectified voltage, but buffers the voltage during the high frequency switch events. At the output side of the rectifier 101 a filter 103 may be provided that enhances the electromagnetic compatibility (EMC) of the apparatus 100. Also connected to the output side of the rectifier 101 is a switch device in the form of a half-bridge 104, which comprises in the embodiments illustrated herein two MOSFET transistors $T_1$ and $T_2$, a common terminal of which is connected to an inductor 105 having an inductance $L_R$. The other terminal of the inductor 105 is connected with a terminal of the gas arc lamp 106, the other electrode of which is connected to a capacitor 107 having a capacity $C_R$. A control circuit 108 is configured so as to provide gate signals for the transistors $T_1$ and $T_2$. Moreover, the control circuit 108 comprises a control input 109 for receiving a control signal for adjusting the illumination of the gas arc lamp 106. For the sake of simplicity, further circuit elements required, for instance, to preheat the electrodes of the gas arc lamp 106, or various protective means for avoiding excess currents and excess voltages are not shown. It should further be noted that a plurality of circuit variants regarding the switching device 104 are known. For instance a full bridge may be used instead of the half bridge or a single switching element may be used as a (resonance) boost converter.

During the operation of the apparatus 100 the AC voltage RST is rectified by means of the rectifier 101, wherein conventional rectifier bridges may be used or, if desired, fast switching diodes having a short reverse recovery time. Due to the direct rectification of the three-phase AC voltage, the rectified voltage exhibits merely a slight waviness of approximately 10%–12% so that contrary to conventional electronic ballast devices this voltage is directly usable without requiring a regulation of the power factor by means of an additional power factor regulator. The control circuit 108 generates the gate control signal for the transistors $T_1$ and $T_2$ in response to an externally supplied or an internally generated control signal at a frequency and/or duty cycle corresponding to the control signal. The resonant circuit formed by the inductor 105, the gas arc lamp 106, and the capacitor 107 is excited by the frequency determined by the externally generated or internally generated control signal so that the gas arc lamp 106 is ignited and radiates. A typical operating frequency is in the range of 20–60 KHz, wherein the minor variations in the illumination caused by the residual waviness of the rectified AC voltage is hardly perceivable or even unperceivable due to the increased frequency that is six times the frequency of the input AC voltage. As already explained, the capacity of the buffer capacitor 102 may advantageously be selected so that during the switch events of the transistor $T_1$ and $T_2$ the voltage remains substantially constant; hence, a value of 0.1 μF or more preferably from 0.1 μF to 0.67 μF is sufficient. Moreover, the residual waviness may be compensated for by a corresponding pre-controller (not shown), wherein the control circuit 108 receives the rectified AC voltage, for instance from a voltage divider, so that a variation in the illumination caused by the residual waviness may be substantially compensated for.

Of course, a buffer capacitor 102 having a high capacity may be provided so as to smooth the residual waviness at the bridge rectifier, which would then, however, require the employment of a bulky electrolyte capacitor that is dimensioned with respect to the expected output current.

Figure 1B:
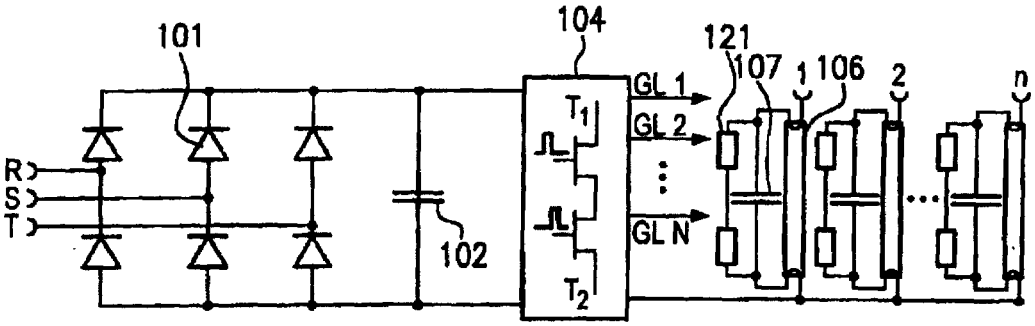
FIG. 1*b* shows a variant of the embodiment illustrated in FIG. 1*a*, wherein the resonant capacitor is provided outside of the circuit board directly at the gas arc lamp.

FIG. 1*b* shows an embodiment that is identical to the embodiment of FIG. 1*a* with respect to driving the gas arc lamp 106. Identical components are thus denoted with the same reference signs and the description of these components is omitted.

In FIG. 1*b* an inductor, such as the inductor 105 of FIG. 1*a*, is connected in series with a coupling capacitor (not shown) having a capacity $C_K$, which may be in the range of, for example, 50–200 nF. The resonance capacity 107 having a capacitance of $C_F$ is directly provided at the gas arc lamp 106 outside of the arrangement for the apparatus 100 in this embodiment. Moreover, a resistor 121, which may be comprised of two or more individual resistors, may be provided in a parallel manner with respect to the resonance capacitor 107 $C_F$. In this embodiment, merely two supply lines to the gas arc lamp 106 are required, wherein nevertheless monitoring of the lamp heating filament as well as a corresponding monitoring of the lamp are possible. For the sake of simplicity, in this embodiment the corresponding supply lines (four terminals per arc lamp in total) are not shown.

The resonance capacitor 107 and, if provided, the resistors 121 may be accommodated within the starter housing. Thus, existing light equipment may also be used with the present invention.

Moreover, a plurality of arc lamps 106 may be driven with respective associated resonance capacitors within the starter housing, wherein only one single common ground line and only one single supply line from a corresponding half bridge 104 is required. In this way, savings in terms of material as well as in terms of effort with respect to installation are achieved compared to a conventional device.

In a further embodiment, which is not shown, the three-way full-wave rectifier 101 and the capacitor are, possibly in combination with additional filter elements, provided on a separate wiring board, which may supply a plurality of half-bridge circuits 104, located on one or more different wiring boards.

Figure 2:
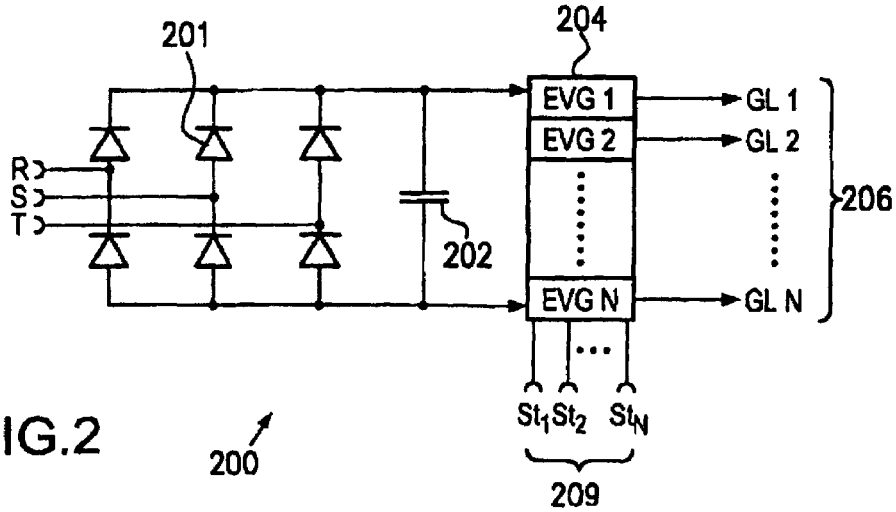
FIG. 2 schematically illustrates an embodiment in which a plurality of electronic ballast devices is combined on a single electronic board.

FIG. 2 schematically illustrates a further embodiment, in which an apparatus 200 for controlling a plurality of gas arc lamps or metal vapor lamps 206 comprises a rectifier 201, again configured as a three-phase full-wave rectifier, an optional buffer capacitor 202 at the output side of the rectifier 201 and a plurality of electronic ballast devices 204, including respective control inputs 209. Due to the omission of power factor regulators required for conventional lamp controls, a plurality of electronic ballast devices may be arranged on a single electronic board in a compact fashion. Due to the omission of the power factor regulators, which would generate additional heat, a moderately large amount of power is controllable by means of a relatively compact control unit. Moreover, alternatively or additionally, an EMC filter may be provided.

Figure 3:
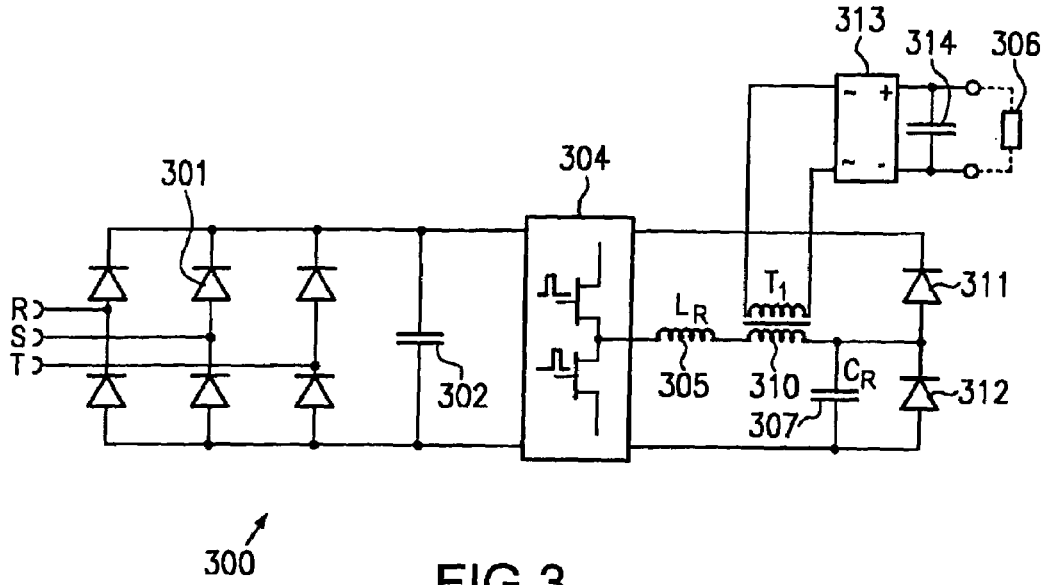
FIG. 3 schematically shows an embodiment in which a transformer is provided in the resonant circuit for matching the gas arc lamp or the metal vapor lamp to the circuit.

FIG. 3 schematically illustrates a further embodiment of an apparatus 300 for operating a gas arc lamp or a metal vapor lamp 306. At the output side of a three-phase full-wave rectifier 301, a buffer capacitor 302 having a capacity in the range of 0.1 μF to 1 μF is provided. A half-bridge circuit 304 is connected to a resonant circuit, including an inductor 305 with an inductance $L_R$, and a capacitor 307 with a capacity $C_R$, and a transformer 310 for matching the voltage to the gas arc lamp 306. Furthermore, a diode half-bridge 311, 312 is provided so as to clamp the capacitor voltage. At the secondary side of the transformer 310, a rectifier 313 in combination with an output capacitor 314 is provided.

During the operation, the half-bridge 304 is driven via a drive circuit, which is not shown, at a frequency that is below the resonant frequency ($F_R=1/(2\pi\sqrt{L_R C_R})$). Upon turning on the upper bridge transistor, a sinusoidal current half-wave is generated, wherein the transformer 310 merely serves as a current source having a voltage that corresponds to the output voltage at the capacitor 314 and thus the voltage at the gas arc lamp 306, which is transformed back to the primary side. In order to assure an optimum energy transfer during this half-wave, preferably the ratio of the windings of the transformers 310 is selected so as to obtain approximately half the bridge voltage at the primary side of the transformer 310 during the rated operation. When the sinusoidal resonant current returns to zero, the capacitor 307 is charged to approximately the bridge output voltage and the resonant current remains at zero, so that the upper bridge transistor may be switched off without any loss.

A corresponding behavior is obtained during the turning on of the lower transistor, where the capacitor 307 is discharged by the sinusoidal resonant current, so as to transfer energy to the gas arc lamp 306. After elapse of the half-wave period, the lower transistor may also be turned off without loss. Because of this arrangement, extremely high switch frequencies may be achieved due to the significantly reduced switching losses, so that the elements determining the resonant frequency may be of very low volume and thus may be inexpensive. Especially the stray inductance of the transformer 310 may be used as the inductance $L_R$, thereby eliminating the necessity for an additional inductor 305.

The energy transfer to the gas arc lamp 306 may be readily controlled by varying the switching frequency of the bridge 304. Due to the reduced switching losses, a significantly improved EMC behavior is achieved, thereby eliminating the necessity for an EMC filter or at least reducing the volume and thus the cost of the filter. By means of this arrangement, switching frequencies in the range of 20 to 1000 kHz may be obtained at a high level of efficiency.

Figure 4:
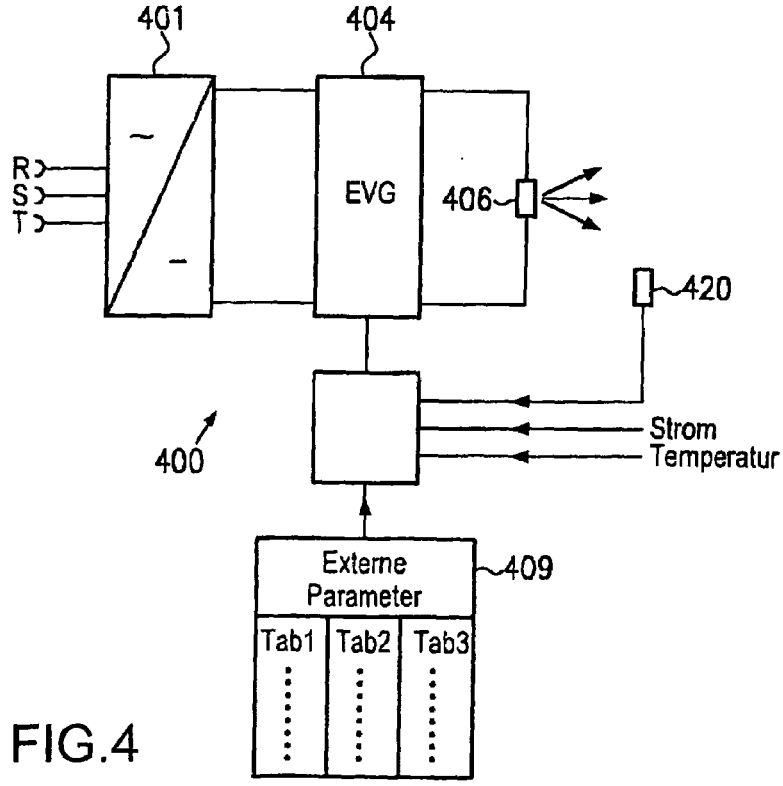
FIG. 4 schematically represents an arrangement in which a gas arc lamp or a metal vapor lamp is controlled by using signals directly obtained from sensor elements and/or by using externally determined parameters.

FIG. 4 schematically depicts a further apparatus 400 for operating a gas arc lamp or a metal vapor lamp 406, wherein a three-phase full-wave rectifier 401 is connected to an electronic ballast device 404, connected to which is the gas arc lamp 406. The electronic ballast device 404 includes an external or an internal control or drive circuit 408, which in turn is connected to a parameter generating unit 409 and/or to one or more sensor elements 420, for instance, configured as a light-sensitive sensor, a current sensor, a temperature sensor, and the like. The apparatus 400 may represent a lighting equipment that may be used in a solarium, in an equipment for light therapy, in applications requiring the sterilization of rooms or objects or medical devices, and the like. Because of the direct usage of the rectified three-phase voltage, a control of the illumination of the gas arc lamp 406 may be achieved in a compact and energy-efficient fashion. Thereby, the control of the illumination may be performed on the basis of parameters, the values of which are determined, for instance, on the basis of signals delivered by the sensor elements 420. For example, the sensor element 420 may detect the spectral distribution and/or the intensity of the presently emitted radiation and may supply a corresponding signal to the control circuit 408. The control circuit may, for instance, comprise an integrator so as to additionally determine the illumination integrated over a predefined time interval. From the currently prevailing and/or the averaged illumination, a control signal may then be established for the desired illumination.

Furthermore, alternatively or additionally, signals may be taken into consideration during the generation of the control signals, which may be supplied from corresponding current sensor elements and/or corresponding temperature sensor elements that monitor, for instance, the temperature of sensitive device portions of the electronic ballast device.

For many applications, it is not only important that the gas arc lamp 406 is controllable in a reliable and energy-saving fashion; of comparable importance is the fact that the control may be performed with respect to important parameters that represent the effect of the radiation output by the gas arc lamp. To this end, the parameter generation unit 409 may comprise respective means so as to establish the control signal in conformity with corresponding parameter values. For instance, the unit 409 may contain corresponding limiting values for the illumination and the duration for operating the gas arc lamp 406 in the form of a table that corresponds to a defined type of skin. This is especially advantageous in a solarium, wherein prior to the beginning of the treatment the type of skin may be determined and then the illumination is performed in relation to the corresponding allowable maximum values or the maximum duration of the illumination.

Additionally, the physical or biological effects on, for example, micro organisms and certain materials may be stored in the unit 409 or may be calculated therein, so as to perform the control of the gas arc lamp 406 with respect to a desired effect of the emitted radiation. For instance, for sterilizing or treating a material or for a medical treatment, a specific illumination or irradiation procedure may be required to obtain an optimum result.

In a preferred embodiment, a feedback loop is provided so that the target value and an actual value of a corresponding manipulated parameter, for instance, the illumination, is obtained, and the actual value is continuously adapted to the target value. A corresponding determination of target values and actual values and of parameter values may be accomplished by means of a micro computer and/or an external source, for instance, in the form of a personal computer and corresponding storage means.

While the present invention is described with reference to individual embodiments, a plurality of variations are within the scope of the invention. For instance, the control and regulation methods and any means required therefore may be implemented in each of the described embodiments.

What is claimed is:

1. The apparatus for controlling the illumination of a gas arc lamp comprising:

a multiphase full-wave rectifier connected with its output side to a multiphase voltage source, a controlled switching device connected with its input side to the output side of the multiphase full-wave rectifier, and connected with its output side to a resonant circuit, to which said gas arc lamp is connectable, and a control circuit for controlling the switching device based on an externally supplied and an internally generated control signal so as to control the energy coupling to the gas arc lamp, wherein the power factor of the apparatus is higher than 0.95 due to the rectified multiphase voltage signal, wherein the apparatus further comprises a pre-controller that is configured to modulate the external control signal inversely to a residual waviness of the rectified multiphase voltage.

2. The apparatus for controlling the illumination of a gas arc lamp, according to claim 1, further comprising a buffer capacitor at the output side of the multiphase fullwave rectifier.

3. The apparatus for controlling the illumination of a gas arc lamp, according to claim 1, wherein a frequency for controlling a half-bridge of said switching device is in the range of 20 kHz to 1 MHz.

4. The apparatus for controlling the illumination of a gas arc lamp, according to claim 1, wherein the apparatus is configured for operating on a three-phase AC voltage grid.

5. The apparatus for controlling the illumination of a gas arc lamp, according to claim 1, further comprising a feedback loop that is configured to control an energy supplied to the gas arc lamp with respect to a manipulated parameter.

6. The apparatus for controlling the illumination of a gas arc lamp, according to claim 5, wherein the manipulated parameter is supplied to the apparatus from an external source.

7. The apparatus for controlling the illumination of a gas arc lamp, according to claim 5, further comprising a sensor element, wherein the manipulated parameter is determined in response to a signal supplied from the sensor element.

8. The apparatus for controlling the illumination of a gas arc lamp, according to claim 5, wherein the manipulated parameter represents at least one of a current supplied to the gas arc lamp, the radiation intensity emitted by the gas arc lamp, the spectral distribution emitted by the gas arc lamp, the effect of the radiation emitted by the gas arc lamp, the temperature of the gas arc lamp and the temperature of the half-bridge.

9. The apparatus for controlling the illumination of a gas arc lamp, according to claim 1, further comprising a parameter-generating unit configured to generate a parameter used for controlling the illumination.

10. The apparatus for controlling the illumination of a gas arc lamp, according to claim 9, wherein the parameter represents at least one of the duration of driving the gas arc lamp and the progression of the illumination with time.

11. The apparatus for controlling the illumination of a gas arc lamp, according to claim 9, wherein the parameter is generated on the basis of at least one of an externally supplied signal and a theoretical model.

12. The apparatus for controlling the illumination of a gas arc lamp, according to claim 11, wherein the parameter represents the physical effect of the radiation emitted by the gas arc lamp on an object.

13. The apparatus for controlling the illumination of a gas arc lamp, according to claim 1, wherein the resonant circuit comprises an inductor and a coupling capacitor connected in a series and wherein a capacitor is provided in parallel to the gas arc lamp and is attached to the gas arc lamp.

14. A controllable illumination apparatus, comprising:

a three-phase full-wave bridge rectifier, a buffer capacitor, having a capacity of less than 1 μF, which is directly arranged at the output side of the three-phase full-wave rectifier, an electronic ballast device having a control terminal, wherein the electronic ballast device is connected to the buffer capacitor without any intermediate active components, and a gas arc lamp connected to the electronic ballast device.

15. The controllable illumination apparatus, according to claim 14, further comprising a feedback loop configured to control the illumination of the gas arc lamp on the basis of a manipulated parameter.

16. The controllable illumination apparatus, according to claim 14, the apparatus comprises a parameter generating unit configured to generate the manipulated parameter on the basis of at least one of parameters supplied to the apparatus or determined by the apparatus.

17. The controllable illumination apparatus, according to claim 16, wherein said parameters indicate at least one of an illumination of the gas arc lamp, a current supplied to the gas arc lamp and an effect caused by radiation irradiated by the gas arc lamp onto a specified object.

* * * * *